US008777373B2

(12) United States Patent
Niihara et al.

(10) Patent No.: US 8,777,373 B2
(45) Date of Patent: Jul. 15, 2014

(54) IMAGE FORMING APPARATUS

(75) Inventors: Takayuki Niihara, Atsugi (JP); Shinichiro Naruse, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 1000 days.

(21) Appl. No.: 12/271,046

(22) Filed: Nov. 14, 2008

(65) Prior Publication Data

US 2009/0136254 A1 May 28, 2009

(30) Foreign Application Priority Data

Nov. 27, 2007 (JP) ..... 2007-306016

(51) Int. Cl.
*B41J 2/165* (2006.01)

(52) U.S. Cl.
USPC ..... 347/37

(58) Field of Classification Search
None
See application file for complete search history.

(56) References Cited

U.S. PATENT DOCUMENTS

| | | | | |
|---|---|---|---|---|
| 4,394,669 | A * | 7/1983 | Ozawa et al. | 347/86 |
| 4,745,414 | A * | 5/1988 | Okamura et al. | 347/30 |
| 2005/0146554 | A1 | 7/2005 | Asanuma et al. | |
| 2005/0194730 | A1 | 9/2005 | Nishida et al. | |
| 2006/0146106 | A1 | 7/2006 | Naruse | |
| 2006/0192833 | A1 * | 8/2006 | Samoto et al. | 347/108 |
| 2006/0209104 | A1 | 9/2006 | Naruse | |
| 2006/0268053 | A1 | 11/2006 | Naruse | |
| 2007/0126787 | A1 | 6/2007 | Naruse | |

FOREIGN PATENT DOCUMENTS

| | | |
|---|---|---|
| JP | 2000-62283 | 2/2000 |
| JP | 2004-130622 | 4/2004 |
| JP | 2004-351727 | 12/2004 |
| JP | 2005-329547 | 12/2005 |
| JP | 2006-1258 | 1/2006 |
| JP | 2006-82381 | 3/2006 |
| JP | 2007-176068 | 7/2007 |

OTHER PUBLICATIONS

Oct. 18, 2011 Japanese official action in connection with a counterpart Japanese patent application.

* cited by examiner

*Primary Examiner* — Alejandro Valencia
(74) *Attorney, Agent, or Firm* — Cooper & Dunham LLP

(57) ABSTRACT

An image forming apparatus includes a carriage, a drive mechanism, a flexible harness, and a support member. The carriage includes a recording head to jet liquid droplets. The drive mechanism, which moves the carriage in a main scanning direction, includes a belt extending in the main scanning direction. The flexible harness, connecting the recording head and another unit, transmits signals between the recording head and another unit. The support member supports the flexible harness in an upright position over the belt. The flexible harness is routed at least partially in the main scanning direction of the carriage. The support member includes a regulation member at an exit portion of the support member to set a vertical height of the support member at the regulation member smaller than a width of the flexible harness.

16 Claims, 9 Drawing Sheets

IMAGE FORMING APPARATUS

CROSS-REFERENCE TO RELATED APPLICATIONS

This application claims priority under 35 U.S.C. §119(a) to Japanese Patent Application No. 2007-306016, filed on Nov. 27, 2007 in the Japan Patent Office, the entire contents of which are hereby incorporated by reference herein.

BACKGROUND

1. Technical Field

This disclosure generally relates to an image forming apparatus including a carriage having a recording head to jet liquid droplet(s).

2. Description of the Background Art

An image forming apparatus used as a printer, facsimile machine, copier, or multi-functional device thereof may have a liquid jetting device including a recording head configured as, for example, a liquid jetting head for jetting liquid droplets of a recording liquid, (e.g., ink). Such image forming apparatuses jet liquid droplet(s) from nozzles of the liquid jetting head to form an image on a recording medium (hereinafter "sheet" or "sheets").

Such image forming apparatuses can be categorized into two types. One type is a serial-type image forming apparatus, in which a recording head jets liquid droplet(s) while moving in a main scanning direction to form an image on a recording sheet. The other type is a line-type image forming apparatus, in which a line-type recording head extending in a width direction of a recording sheet jets liquid droplet(s) without moving the recording head to form an image.

In the above mentioned serial-type image forming apparatus, a carriage including a recording head may be connected to another unit, such as for example a control unit, by using a flexible harness, by which the recording head can be activated and driven by signal(s) generated by the control unit. The flexible harness having a given flexibility may also be called as a flat cable, a flexible flat cable, or a flexible board. With such a configuration, the flexible harness can be moved along a movement of the carriage while changing a shape of the flexible harness. Several image forming apparatuses using such a flexible harness have been proposed, such as Japanese Patent Application Publication Nos. 2006-082381, 2007-176068, and 2004-351727.

In the serial-type image forming apparatus, the flexible harness needs to be moved corresponding to a movement of the carriage. Accordingly, some portion of the flexible harness, which is between the carriage and the control unit or the like, cannot be fixedly attached to a housing or the like of the image forming apparatus but must be free to move. Such unfixed or free portion of the flexible harness can be called a "free harness portion." If the "free harness portion" of the flexible harness falls under its own weight, however, the flexible harness may interfere with an adjacent component or the like, such as a belt for moving the carriage in the main scanning direction.

Such interference of the flexible harness with an adjacent component can be prevented by providing a larger clearance therebetween. However, such a larger clearance may not be possible to provide because of increasing market demand for smaller, more compact image forming apparatuses.

BRIEF SUMMARY

In an aspect of this disclosure, there is provided an image forming apparatus that includes a carriage, a drive mechanism, a flexible harness, and a support member. The carriage includes a recording head to jet liquid droplets. The drive mechanism, which moves the carriage in a main scanning direction, includes a belt extending in the main scanning direction. The flexible harness, connecting the recording head and another unit, is used for transmission of signals between the recording head and another unit. The support member supports the flexible harness in an upright position over the belt. The flexible harness is routed at least partially in the main scanning direction of the carriage. The support member includes a regulation member at an exit portion of the support member to set a vertical height of the support member at the regulation member smaller than a width of the flexible harness.

BRIEF DESCRIPTION OF THE DRAWINGS

A more complete appreciation of the aforementioned and other aspects, advantages and features thereof can be readily obtained and better understood from the following detailed description with reference to the accompanying drawings, wherein.

Figure 1:
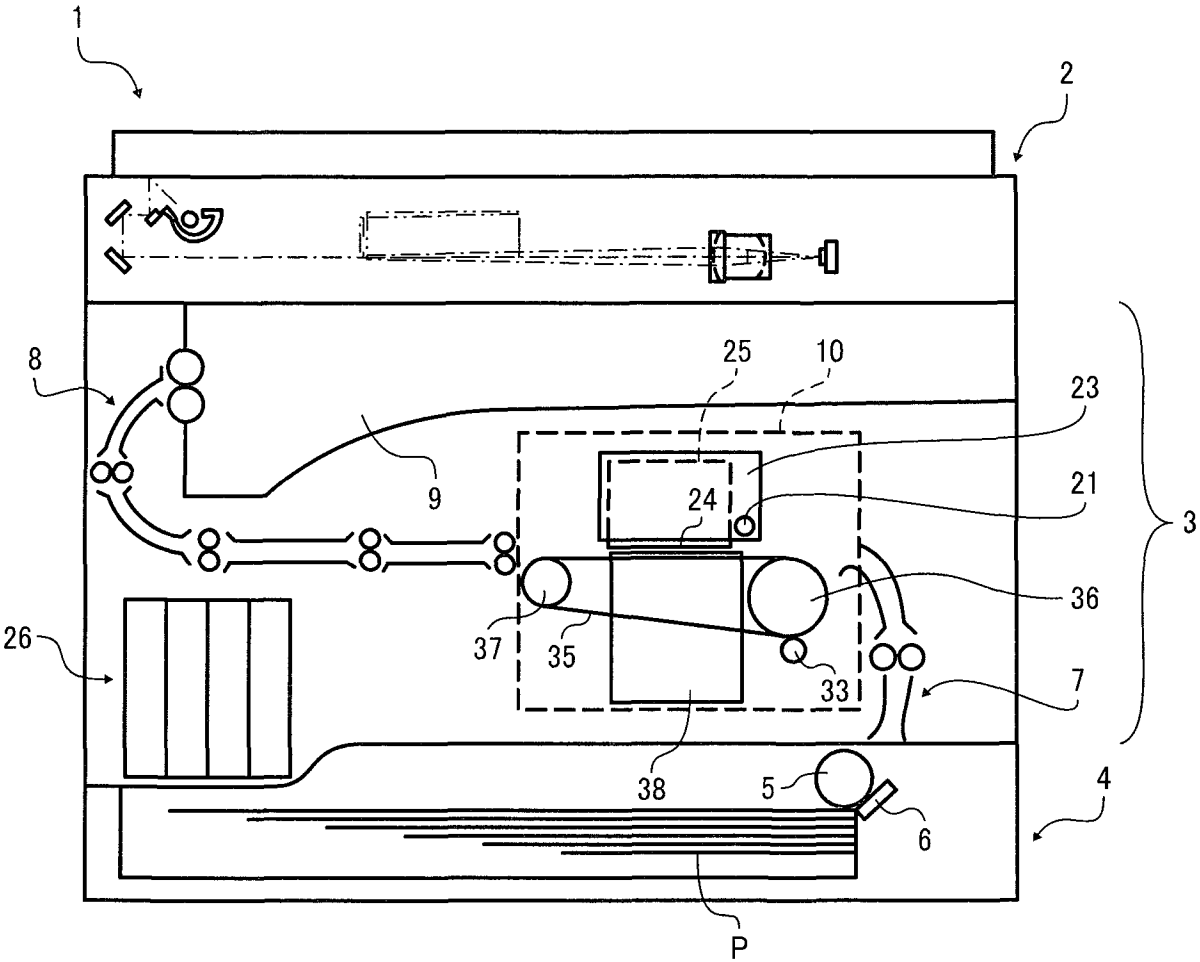
FIG. 1 illustrates a schematic configuration of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

The term "sheet" used herein refers to a medium, a recording medium, a recorded medium, a sheet material, a transfer material, a recording sheet, a paper sheet, or the like. The sheet may also be made of material such as paper, string, fiber, cloth, leather, metal, plastic, glass, timber, and ceramic, for example. Further, the term "image formation" used herein refers to providing, recording, printing, or imaging an image, a letter, a figure, a pattern, or the like onto the sheet.

Further, the term "liquid" used herein is not limited to a recording agent or ink, and may include anything jetted in the form of a fluid. Hereinafter, such liquid may be simply referred to as "ink". Furthermore, the term "liquid jetting device" refers to a device for jetting liquid droplet(s) from a liquid jetting head to form an image, a letter, a figure, a pattern, or the like.

Referring now to the drawings, an image forming apparatus according to an exemplary embodiment is described with respect to FIGS. 1 to 4. The image forming apparatus may be an inkjet printer, for example, but is not limited thereto.

Figure 2:
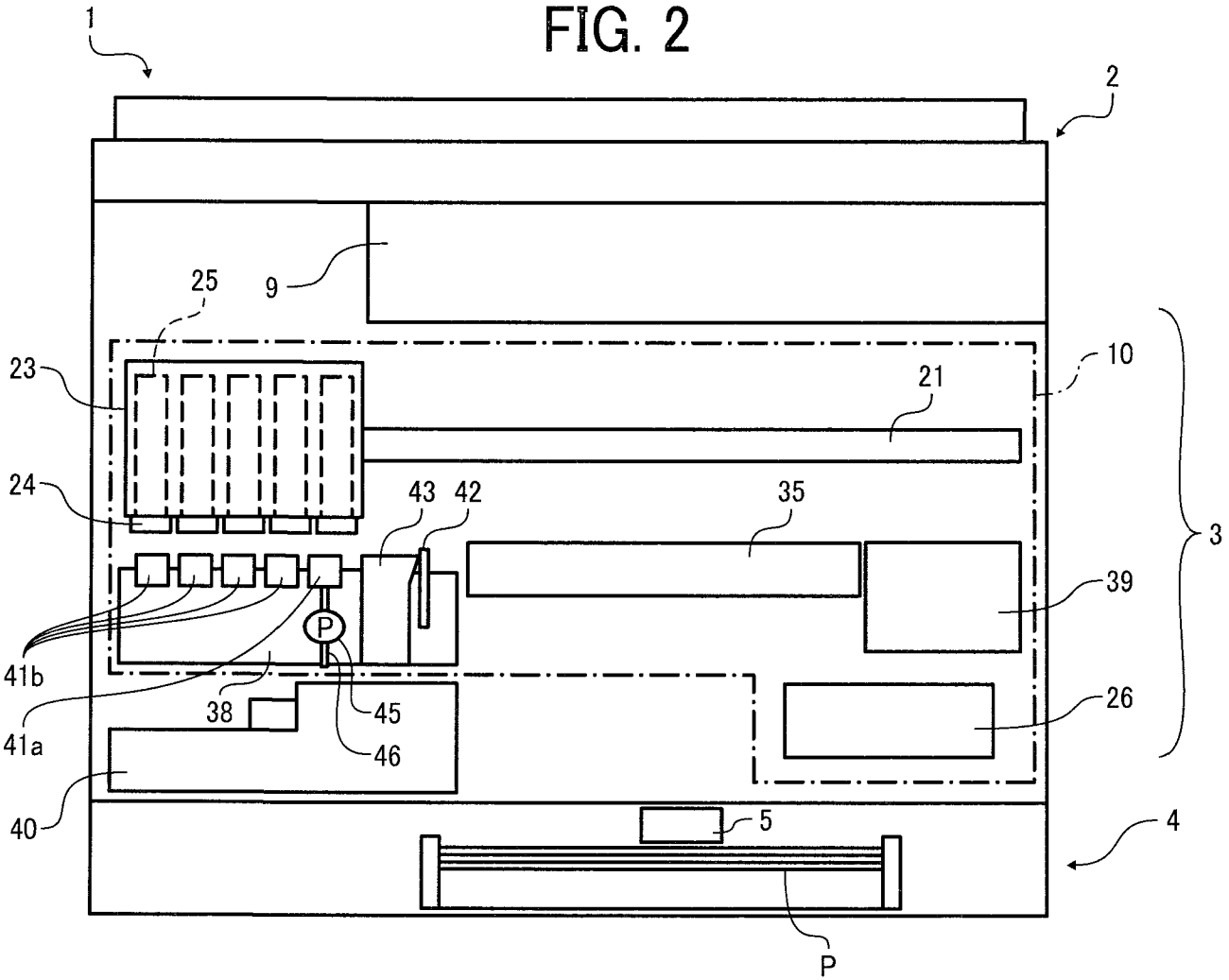
FIG. 2 illustrates a front view of the image forming apparatus of FIG. 1.
Figure 3:
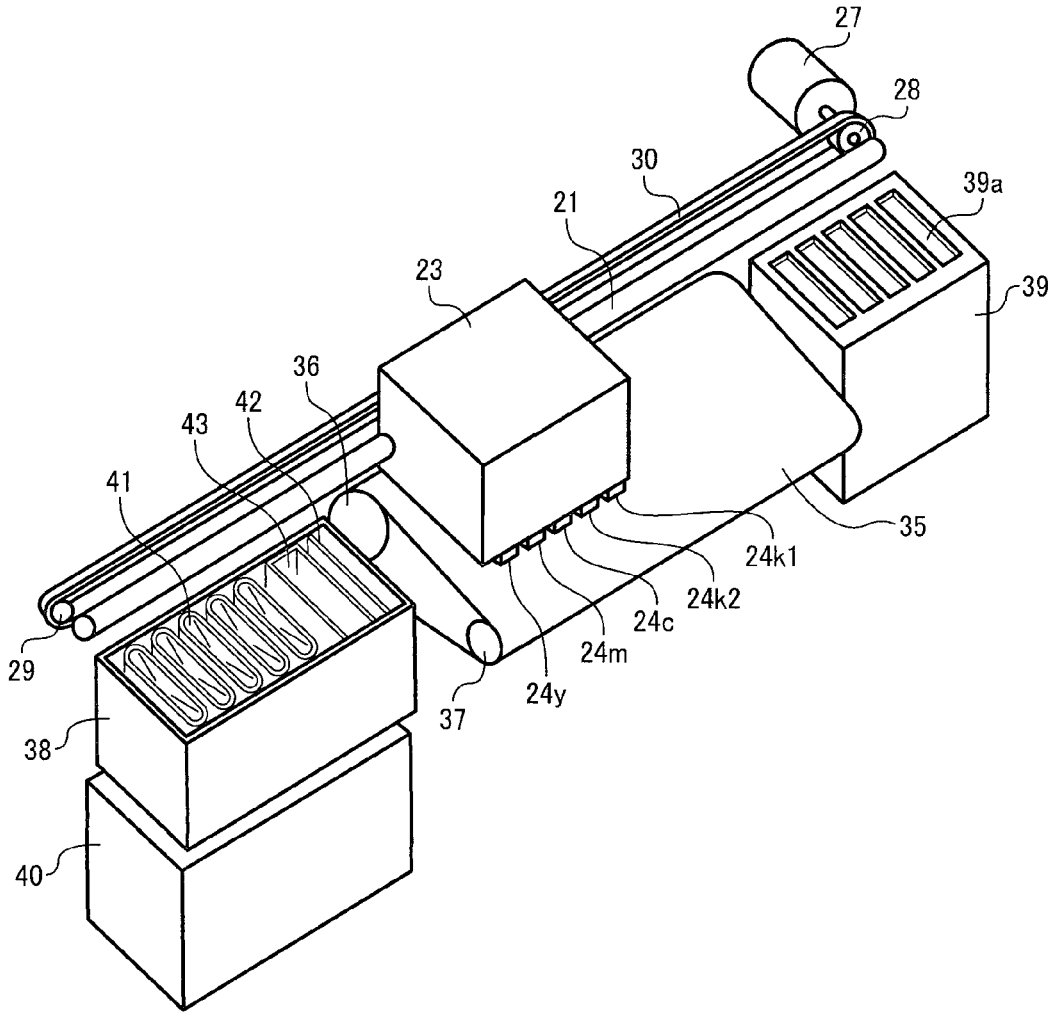
FIG. 3 illustrates a perspective view of a printing section of the image forming apparatus of FIG. 1.
Figure 4:
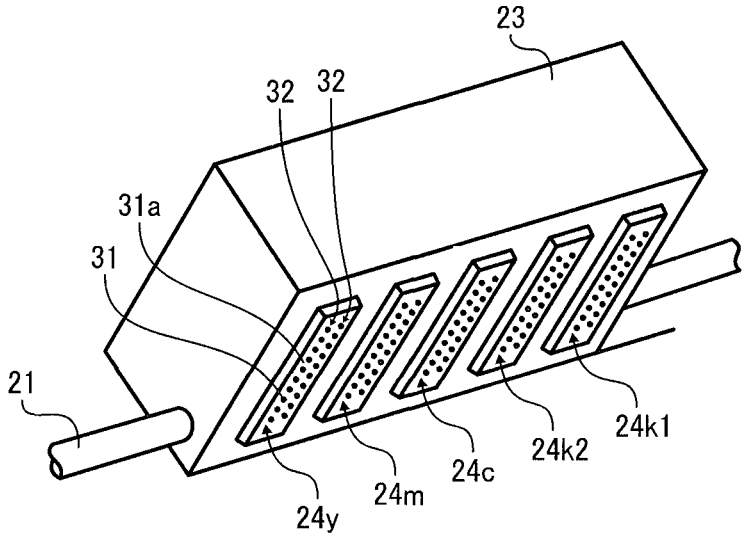
FIG. 4 illustrates a perspective view of a carriage of the printing section, which is viewed from the bottom side.

FIG. 1 illustrates a schematic configuration of an image forming apparatus 1 according to an exemplary embodiment. FIG. 2 illustrates a front view of the image forming apparatus 1 of FIG. 1. FIG. 3 illustrates a perspective view of a recording unit of the image forming apparatus 1 of FIG. 1. FIG. 4 illustrates a perspective view of a carriage of the image forming apparatus 1 of FIG. 1, viewed from a bottom side of the carriage.

The image forming apparatus 1 may be a copier, but not limited thereto. The image forming apparatus 1 includes an image scanning unit 2, an image forming unit 3, and a sheet cassette 4, for example. The image scanning unit 2 scans a document image. The image forming unit 3 forms an image on a recording medium, such as a transfer sheet P. The sheet cassette 4 feeds the transfer sheet P to the image forming unit 3. The transfer sheet P, stored in the sheet cassette 4, is fed by a sheet feed roller 5 and a separation pad 6 one by one to a printing section 10 via a sheet transport path 7 so that an image is recorded on the transfer sheet P. Then, the transfer sheet P having the image is ejected through a sheet ejection path 8 and stacked on a sheet stack 9.

As illustrated in FIG. 3, the printing section 10 includes a guide rod 21, a guide stay, a carriage 23, a main motor 27, a drive pulley 28, a driven pulley 29, and a timing belt 30, for example. The carriage 23 is slidably supported on the guide rod 21 and the guide stay to move the carriage 23 in a main scanning direction. The timing belt 30 is extended by the drive pulley 28 and the driven pulley 29. When the main motor 27 drives the drive pulley 28, the timing belt 30 travels in a given direction, by which the carriage 23 can be moved in the main scanning direction.

The carriage 23 includes recording heads 24*k* (24*k*1, 24*k*2), 24*c*, 24*m*, 24*y*, and a sub-tank 25 corresponded to each of the recording heads 24*k*, 24*c*, 24*m*, and 24*y*, for example. Each of the recording heads 24*k*, 24*c*, 24*m*, and 24*y* includes a liquid jetting head to respectively jet black(K) ink, cyan(C) ink, magenta(M) ink, and yellow(Y) ink, and the sub-tank 25 stores a given volume of ink to be supplied to each of the recording heads 24*k*, 24*c*, 24*m*, and 24*y*. Because the recording heads 24*k*, 24*c*, 24*m*, and 24*y* have a similar configuration one to another except color, these recording heads may be referred to as the recording head 24. Although the recording head for black color includes two recording heads 24*k*1 and 24*k*2 in FIG. 5, the recording head for black color may be set to one recording head.

As illustrated in FIG. 4, the recording head 24 includes a nozzle face 31*a*, in which a plurality of nozzles 31 are arrayed in two rows, for example, to jet liquid droplet(s). Each of the rows may be referred to as a nozzle array 32. The nozzle array 32 is aligned in a direction perpendicular to the main scanning direction (or a moving direction of the carriage 23). The carriage 23 faces its nozzle face 31*a* to a downward direction, which faces the transfer sheet P.

The image forming apparatus 1 further includes an ink cartridge 26, which is a main tank to supply ink to the sub-tank 25 connected to the recording head 24. The ink cartridge 26 can be detachably mountable to the image forming apparatus 1.

The recording head 24 may be selected from different types of liquid jetting heads. Such a liquid jetting head may typically include nozzle orifices to jet liquid droplets having diameters of from several micrometers to tens of micrometers, a chamber in connection with the orifices, and a vibration plate forming a wall surface of the chamber.

For example, such a liquid jetting head includes a piezoelectric actuator, such as a piezoelectric element, to apply pressure to liquid in the chamber via the vibration plate so as to jet liquid droplets.

Alternatively, another liquid jetting head includes a thermal actuator to apply pressure to the liquid in the chamber. Such a thermal actuator uses an electricity-to-heat conversion element to generate film boiling and thus a phase change of the liquid causes a jetting of liquid droplets.

Still another liquid jetting head includes an electrostatic force actuator to apply pressure to liquid in the chamber having a vibration plate and an electrode. The volume of the chamber can be changed by displacing the vibration plate using electrostatic force generated between the vibration plate and the electrode so as to jet liquid droplets.

The image forming apparatus 1 further includes a transport belt 35, extended by a drive roller 36 and a driven roller 37, under the carriage 23. The transport belt 35, which may be an endless belt, transports the transfer sheet P by adhering the transfer sheet P on the transport belt 35 with electrostatic force. When the transport belt 35 travels in a given direction by rotating the drive roller 36 and the driven roller 37, the transfer sheet P can be transported in a direction perpendicular to the main scanning direction. Further, a charge roller 33 is contacted to the transport belt 35 so that the charge roller 33 rotates with such a traveling movement of the transport belt 35. The rotating charge roller 33 charges the transport belt 35.

As illustrated in FIG. 2 and FIG. 3, the image forming apparatus 1 further includes a head refreshing unit 38 at one end side of the main scanning direction of the carriage 23, and a dummy jetting unit 39 at the other end side of the main scanning direction of the carriage 23. The head refreshing unit 38 is used to maintain or refresh a condition of the nozzles 31 on the recording head 24. The dummy jetting unit 39 is used to jet some ink without conducting an actual image forming.

The head refreshing unit 38 includes a plurality of cap members 41, a wiping blade 42, and a jetted ink receiver 43, for example. The cap members 41 may include a suction cap 41*a* and three moisturizing caps 42*b*, for example. The cap members 41 (or the suction cap 41*a* and the moisturizing caps 42*b*) cap the nozzle face 31*a* of the recording head 24. The wiping blade 42 wipes the nozzle face 31*a* of the recording head 24. The suction cap 41*a* is connected to a suction pump 45, which may be a tube pump, for example. Ink suctioned by the suction cap 41*a* is ejected to a waste liquid tank 40 via the suction pump 45 and a waste liquid tube 46. The waste liquid tank 40, storing the waste ink, may be disposed under the suction cap 41*a*. Further, the dummy jetting unit 39 may include four openings 39*a*.

A description is now given of a configuration for supporting a flexible harness in the image forming apparatus 1 according to an exemplary embodiment with reference to FIG. 5 to FIG. 8.

Figure 5:
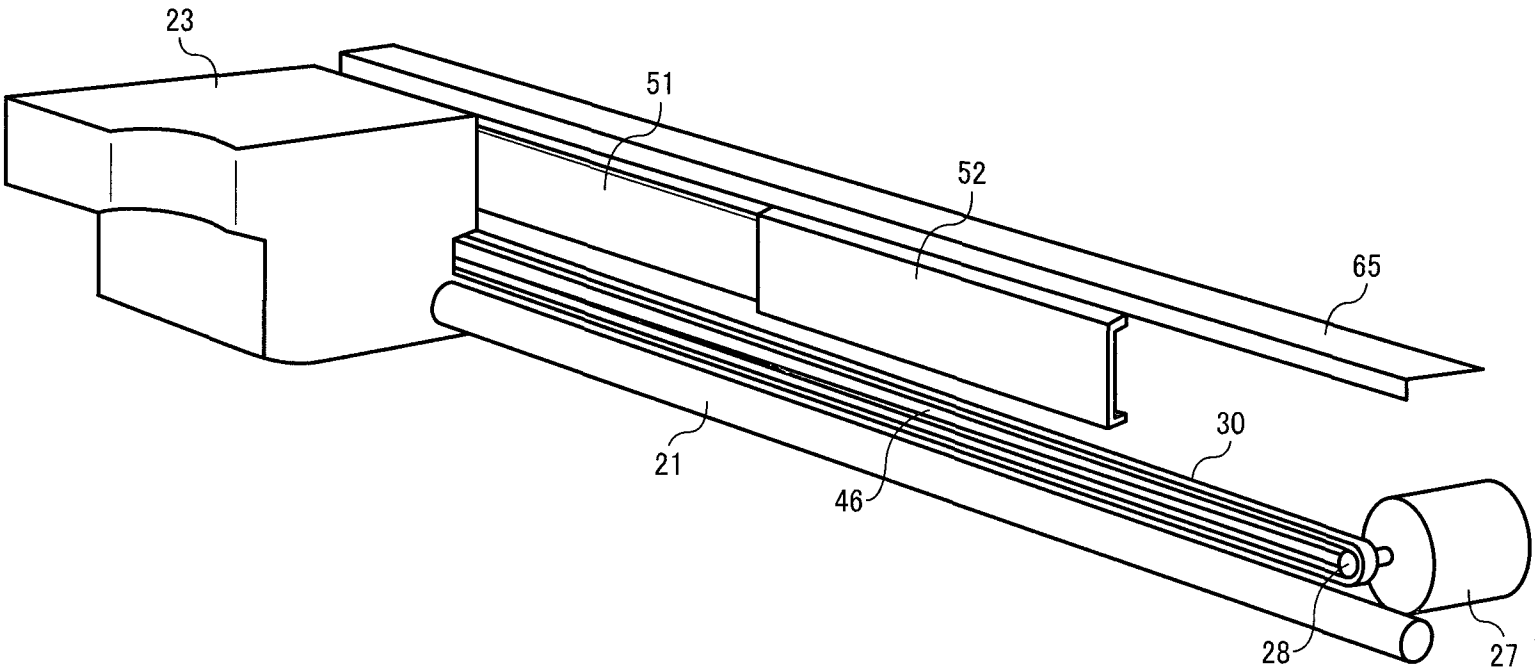
FIG. 5 illustrates a perspective view of a configuration of an image forming engine unit according to an exemplary embodiment.
Figure 6:
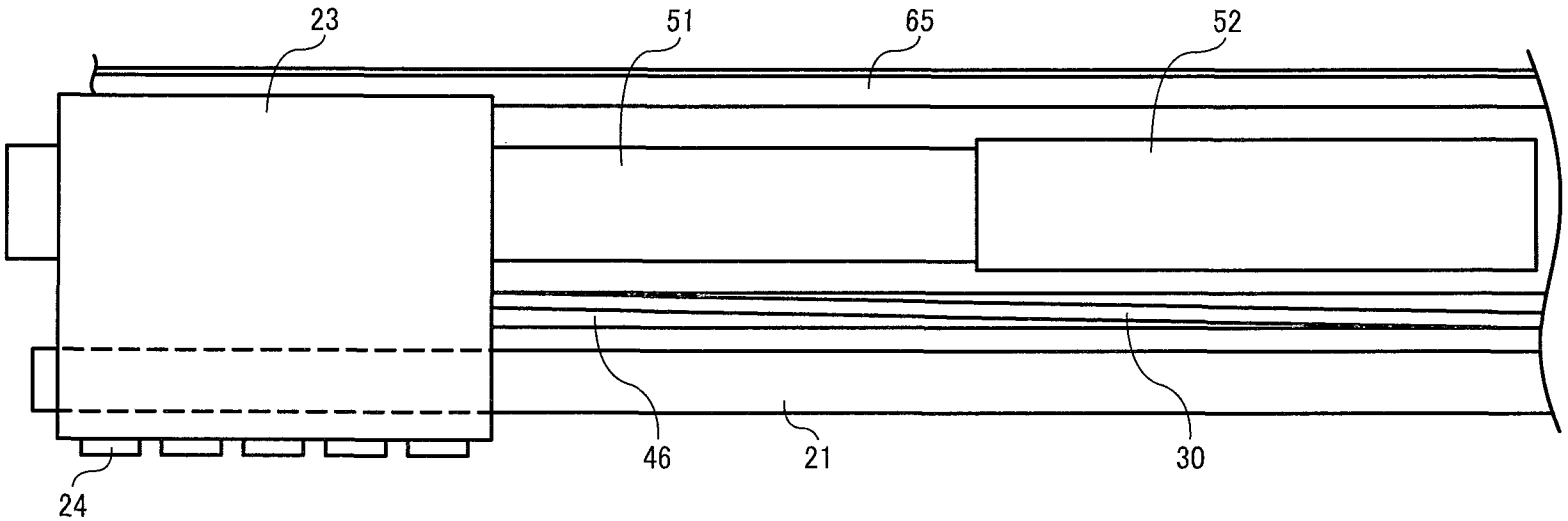
FIG. 6 illustrates a front view of the configuration of the image forming engine unit of FIG. 5.
Figure 7:
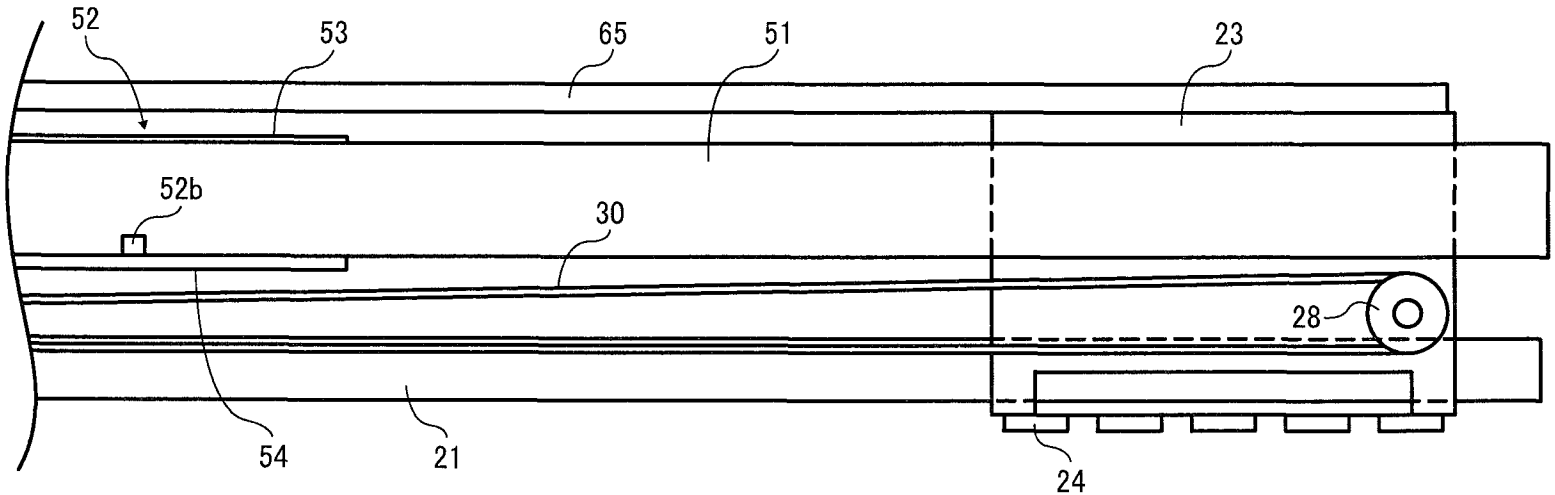
FIG. 7 illustrates a rear view of the configuration of the image forming engine unit of FIG. 5.
Figure 8:
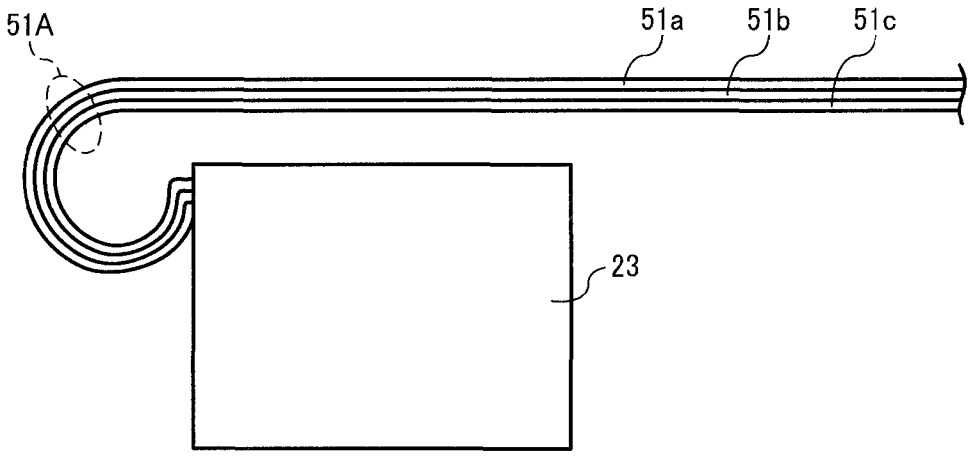
FIG. 8 illustrates a plan view of the configuration of the image forming engine unit of FIG. 5, in which a routing of flexible harness is shown.
Figure 9:
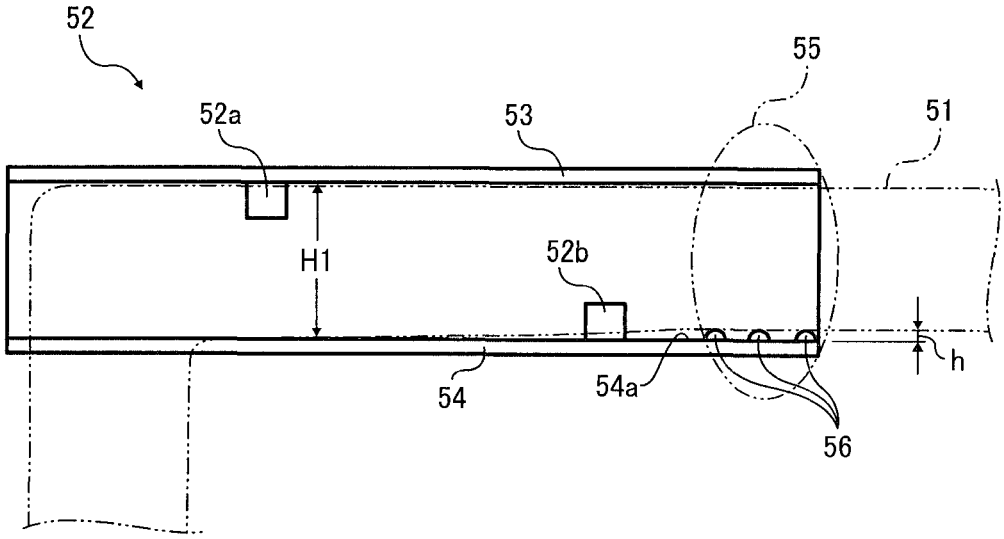
FIG. 9 illustrates a schematic view of a support member for supporting the flexible harness.
Figure 10:
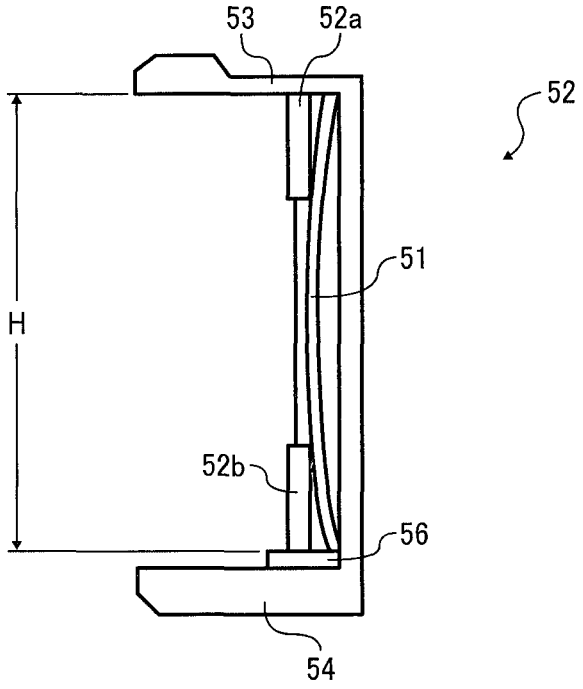
FIG. 10 illustrates a side view of the support member of FIG. 9.
Figure 11:
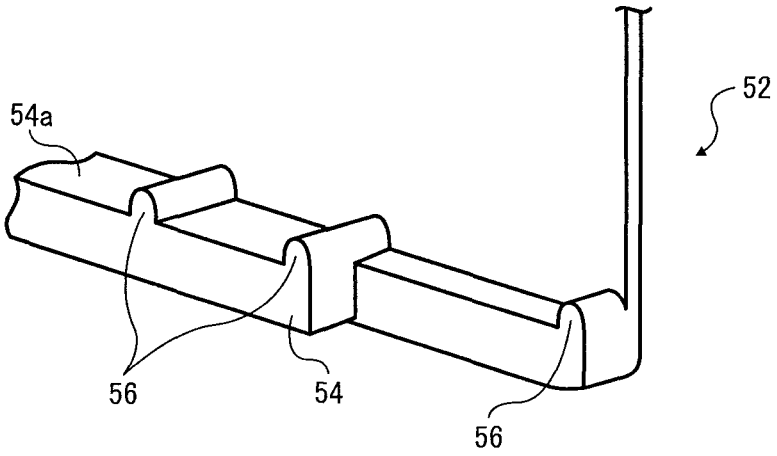
FIG. 11 illustrates an expanded perspective view of the support member of FIG. 9.

FIG. 5 illustrates a perspective view of a configuration of an image forming engine unit according to an exemplary embodiment. FIG. 6 illustrates a front view of the configuration of the image forming engine unit of FIG. 5. FIG. 7 illustrates a rear view of the configuration of the image forming engine unit of FIG. 5. FIG. 8 illustrates a plan view of the configuration of the image forming engine unit of FIG. 5, in which a routing of flexible harness is shown. FIG. 9 illustrates a schematic view of a support member for supporting the flexible harness. FIG. 10 illustrates a side view of the support member of FIG. 9. FIG. 11 illustrates an expanded perspective view of the support member of FIG. 9.

In the image forming apparatus 1, the carriage 23 may be connected to another unit, such as for example a control unit, by using a flexible harness band 51. With such a configuration, the recording head 24 can communicate transmission signal(s) with another unit via the flexible harness band 51.

The flexible harness band 51 may be routed from a bottom side of the image forming apparatus 1 and under a guide stay 65, for example. Then the flexible harness band 51 may be routed along and over the timing belt 30 in a main scanning direction of the carriage 23, and then curved for some amount and supported by the carriage 23. The guide stay 65 may support the carriage 23, which is slide-able on the guide stay 65. Further, a linear encoder scale 46 may be disposed in front of the timing belt 30 to detect a position of the carriage 23 in the main scanning direction.

The flexible harness band 51 may include a plurality of flexible harnesses. For example, in an exemplary embodiment, the flexible harness band 51 includes three flexible harnesses 51*a*, 51*b*, and 51*c* as illustrated in FIG. 8. Such flexible harnesses 51*a*, 51*b*, and 51*c* can be fixed together at a curved portion 51A with an adhesive or tape, for example. To simplify a drawing description, the flexible harness band 51 is illustrated as one flexible harness except FIG. 8.

If a plurality of flexible harnesses is used, the flexible harnesses may not be aligned in a same direction precisely, and a position of the flexible harnesses may be deviated each other. Such positional deviation becomes larger at a position which is far from a given fixing point of the plurality of flexible harnesses. Specifically, the farther from the fixing point, the larger the positional deviation of the flexible harnesses in a thrust direction. Such positional deviation in the thrust direction may become too great at a position where the flexible harnesses are bended in a shaper angle. Accordingly, by fixing the flexible harnesses 51*a*, 51*b*, and 51*c* at the curved portion 51A, a falling down of the flexible harnesses 51*a*, 51*b*, and 51*c* can be effectively prevented.

As illustrated in FIGS. 9 and 10, a support member 52 includes a flange at its upper and lower side. For example, the support member 52 includes flanges 53 and 54 at its upper and lower side, by which the support member 52 has a U-shaped form in its cross-section as illustrated in FIG. 10. Although the flanges 53 and 54 may extend in an entire length of the support member 52 as shown in FIG. 9, such upper and lower flanges may not be required to extend in an entire length of the support member 52. For example, an upper flange may be configured with a plurality of segmented flanges and a lower flange may be configured with a plurality of segmented flanges, in which a plurality of shorter flanges may exist with a given interval.

Each of the flange 53 (an upper flange) and the flange 54 (a lower flange) has at least one rib used for preventing a falling down of the flexible harness band 51. For example, the flange 53 and the flange 54 include ribs 52*a* and 52*b* respectively, by which the flexible harness band 51 can be held in an upright position effectively.

The support member 52 further includes a plurality of projections 56 on the flange 54 at an exit portion 55 of the support member 52. The flexible harness band 51 may exit from the support member 52 at the exit portion 55 of the support member 52. Specifically, the projections 56 project from a support face 54*a* of the flange 54, by which some lower side of the flexible harness band 51 can be held in a position higher than other part of lower side of the flexible harness band 51. Specifically, the flexible harness band 51 can be held in a higher position for a height "h" at the exit portion 55 as shown in FIG. 9. Accordingly, at the exit portion 55 of the support member 52, the flange 53 and the projection 56 regulate a position of the flexible harness band 51 in a vertical direction. In such a configuration, a distance "H" between the flange 53 and the projection 56 (see FIG. 10) is set smaller than a vertical direction width "H1" (see FIG. 9) of the flexible harness band 51.

With such a configuration, the flexible harness band 51 can be supported in a warped-condition near the exit portion 55 of the support member 52 as illustrated in FIG. 10, and then the flexible harness band 51 is extended outside the support member 52. As illustrated in FIG. 10, the flexible harness band 51 can be warped in its width direction. Accordingly, the flexible harness band 51 has a greater "stiffness" by such warped condition, and thereby the flexible harness band 51 may not fall down by its own weight in a portion between the exit portion 55 of the support member 52 and the carriage 23, wherein such portion is not supported with a support member. If falling down of the flexible harness band 51 can be prevented effectively, an interference between the flexible harness band 51 and the timing belt 30 disposed under the flexible harness band 51 can be prevented even if a clearance between the flexible harness band 51 and the timing belt 30 is small. Similarly, such interference may be prevented for another component disposed near the flexible harness band 51.

Further, the flange 54 includes the projection 56 to hold up a lower side of the flexible harness band 51. Accordingly, even if some falling down of the flexible harness band 51 by its own weight may occur, such falling down can be compensated by a hold up effect by the projection 56. Therefore, a layout for devices under the flexible harness band 51 can be designed more freely because the falling down of the flexible harness band 51 can be suppressed or prevented effectively.

As above described, the flexible harness band 51 can be positioned in an upright position over the timing belt 30, and some portion of the flexible harness band 51 can be routed at least partially in a main scanning direction (or a moving direction) of the carriage 23. The flexible harness band 51 can be supported by the support member 52 provided in the image forming apparatus 1. The support member 52 includes the projection 56 at the exit portion 55 of the support member 52 to regulate a distance of the flexible harness band 51 in a vertical direction.

In such a configuration, the distance "H" between the flange 53 and the projection 56 (see FIG. 10) is set smaller than a vertical direction width "H1" (see FIG. 9) of the flexible harness band 51. With such a configuration, the flexible harness band 51 can be supported in a warped-condition at the exit portion 55 of the support member 52 as illustrated in FIG. 10, and then the flexible harness band 51 is extended outside the support member 52. As illustrated in FIG. 10, the flexible harness band 51 can be warped in its width direction. Accordingly, the flexible harness band 51 has a greater "stiffness" by such warped condition, and thereby the flexible harness band 51 may not fall down by its own weight in a portion between the exit portion 55 of the support member 52 of the carriage 23. If the falling down of the flexible harness band 51 can be prevented, an interference between the flexible harness band 51 and other adjacent devices can be prevented even if a clearance between the flexible harness band 51 and the other adjacent devices is narrow.

In such a configuration, a stiffness of flexible harness can be enhanced as above described to prevent a falling down of flexible harness by its own weight, by which interference of the flexible harness and adjacent component or device can be prevented even if a clearance between the flexible harness and the adjacent component or device devices is small.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a carriage including an imaging member;

a drive mechanism configured to move the carriage in a main scanning direction;

a flexible harness, connecting the imaging member and a control unit of the image forming apparatus, configured to be used for transmission of signals between the imaging member and the control unit; and a support member configured to support the flexible harness in an upright position in the image forming apparatus, the flexible harness being routed at least partially through the support member in the main scanning direction of the carriage, the support member including a regulation member, wherein a distance between an upper bounding part of the support member and the regulation member is configured to be smaller than a width of the flexible harness, wherein the regulation member of the support member projects from a lower bounding part of the support member, and the regulation member supports a first portion of a lower side of the flexible harness at a higher position than a second portion of the lower side of the flexible harness that is supported directly by the lower bounding part of the support member.

2. The image forming apparatus according to claim 1, wherein the flexible harness includes a plurality of harnesses arranged side by side, and the plurality of harnesses are fixed together at a curved-shape portion of the plurality of harnesses.

3. The image forming apparatus according to claim 1, wherein the regulation member includes one or more curved projections that extend outward from a lower bounding part of the support member.

4. An image forming apparatus, comprising:

a carriage including an imaging member;

a drive mechanism configured to move the carriage in a main scanning direction;

a flexible harness, connecting the imaging member and a control unit of the image forming apparatus, configured to be used for transmission of signals between the imaging member and the control unit; and a support member configured to support the flexible harness in an upright position in the image forming apparatus, the flexible harness being routed at least partially through the support member in the main scanning direction of the carriage, the support member including a regulation member, wherein a distance between an upper bounding part of the support member and the regulation member is configured to be smaller than a width of the flexible harness, wherein a portion of the flexible harness is caused to be warped in a width direction of the flexible harness by the upper bounding part and the regulation member.

5. The image forming apparatus according to claim 4, wherein the flexible harness includes a plurality of harnesses arranged side by side, and the plurality of harnesses are fixed together at a curved-shape portion of the plurality of harnesses.

6. The image forming apparatus according to claim 4, wherein the regulation member includes one or more curved projections that extend outward from a lower bounding part of the support member.

7. The image forming apparatus according to claim 4, wherein the flexible harness exits the support member at an exit portion of the support member, and the regulation member is disposed at the exit portion of the support member.

8. The image forming apparatus according to claim 7, wherein a distance between the upper bounding part and a lower bounding part of a non-exit portion of the support member is set to be equal to or greater than the width of the flexible harness, such that a portion of the flexible harness supported at the non-exit portion of the support member is not caused to be warped in a width direction.

9. The image forming apparatus according to claim 1, wherein the flexible harness exits the support member at an exit portion of the support member, and the regulation member is disposed at the exit portion of the support member.

10. The image forming apparatus according to claim 9, wherein a portion of the flexible harness supported at the exit portion of the support member is caused to be warped in a width direction of the flexible harness by the upper bounding part and the regulation member,

11. The image forming apparatus according to claim 9, wherein a distance between the upper bounding part and a lower bounding part of a non-exit portion of the support member is set to be equal to or greater than the width of the flexible harness, such that a portion of the flexible harness supported at the non-exit portion of the support member is not caused to be warped in a width direction.

12. An image forming apparatus, comprising:

a moving member;

a flexible harness, connecting the moving member and a control unit of the image forming apparatus, configured to be used for transmission of signals between the moving member and the control unit; and a support member configured to support the flexible harness, the flexible harness being routed at least partially through the support member, the support member including a regulation member configured to warp the flexible harness in a width direction of the flexible harness, wherein the flexible harness is caused to be warped in the width direction of the flexible harness, such that a middle portion of the flexible harness in the width direction of the flexible harness is caused to be positioned farther from the moving member than an upper and a lower portion of the flexible harness.

13. The image forming apparatus according to claim 12, wherein the flexible harness is caused to be warped in the width direction of the flexible harness by an upper bounding part and the regulation member.

14. The image forming apparatus according to claim 12, wherein the support member includes a wall face that faces the moving member and covers the warped flexible harness, such that the moving member and the warped flexible harness are positioned on opposing sides of the wall face, and a middle portion of the warped flexible harness does not contact the support member.

15. The image forming apparatus according to claim 12, wherein the support member is configured to support the flexible harness in an upright position, and includes an upper rib member and a lower rib member configured to engage the warped flexible harness and prevent the warped flexible harness from moving away from said upright position.

16. The image forming apparatus according to claim 12, wherein the flexible harness exits the support member at an exit portion of the support member, and a distance between an upper bounding part and a lower bounding part of a non-exit portion of the support member is set to be equal to or greater than the width of the flexible harness, such that a portion of the flexible harness supported at the non-exit portion of the support member is not caused to be warped in the width direction.

* * * * *